United States Patent [19]

Nozato

[11] Patent Number: 4,561,414

[45] Date of Patent: Dec. 31, 1985

[54] BALL THROWING MACHINE

[76] Inventor: Fujio Nozato, 33-20, Izuo 1-chome, Taisho-ku Osaka-shi, Osaka-fu, Japan

[21] Appl. No.: 626,176

[22] Filed: Jun. 29, 1984

[30] Foreign Application Priority Data

Mar. 12, 1984 [JP] Japan ..... 59-35854[U]
Mar. 12, 1984 [JP] Japan ..... 59-35855[U]

[51] Int. Cl.[4] ..... F41B 3/04

[52] U.S. Cl. ..... 124/78; 248/181; 403/90

[58] Field of Search ..... 124/78, 6; 248/181, 248/182; 403/90

[56] References Cited

U.S. PATENT DOCUMENTS 3,704,645 12/1972 Grauso et al. ..... 403/90 X
3,774,584 11/1973 Paulson ..... 124/78
3,815,892 6/1974 Tulk ..... 248/181 X
4,323,048 4/1982 Saito et al. ..... 124/78

FOREIGN PATENT DOCUMENTS 2935003 12/1980 Fed. Rep. of Germany ..... 403/90
1057682 10/1953 France ..... 403/90
2040353 8/1980 United Kingdom ..... 403/90

*Primary Examiner*—Paul E. Shapiro
*Attorney, Agent, or Firm*—Armstrong, Nikaido, Marmelstein & Kubovcik

[57] ABSTRACT

A ball throwing machine body having a pair of rotatable bodies adapted to nip a ball therebetween to throw it and a support member of ball joint type for supporting the ball throwing machine body on a pillar member. The support member enables the ball throwing machine body to be turned around an axis extending in the ball throwing direction and to be fixed at a desired position.

5 Claims, 5 Drawing Figures

BALL THROWING MACHINE

BACKGROUND OF THE INVENTION

This invention relates to a ball throwing machine used for baseball practice, e.g., for practicing batting balls and catching batted balls.

A prior art of such ball throwing machine is disclosed in U.S. Pat. No. 3,724,437. In this disclosed arrangement, the ball throwing machine body has a pair of rotatable bodies which are adapted to be rotated in opposite directions and at different speeds relative to each other. Balls are successively nipped between these two rotatable bodies and thrown. In this case, a spin is imparted to the ball to a degree which depends on the difference between the rotative speeds of the rotatable bodies to produce different types of pitches, such as a shoot and a curve. Further, said ball throwing machine body is supported on a base through support means.

In this connection, in doing the aforesaid practice using a ball throwing machine, it is desired that the ball throwing direction can be changed to some extent and that the direction of spin of the ball can be arbitrarily selected so that the ball is thrown in a desired type of pitch. To this end, it has been proposed to construct the aforesaid support means in the ball joint type, as shown in U.S. Pat. No. 3,774,585.

That is, in this construction, a ball body is mounted to project upwardly from a base. On the other hand, the ball throwing machine body is provided with a holder member for holding said ball body, said holder member being adapted to be turnable around the center of the ball body. Further, the holder member is so arranged that it is fixed to the ball body in its arbitrary angular position relative to the ball body. And, the turning of the holder member allows the ball throwing machine body to assume various postures.

The aforesaid arrangement, however, has the follwoing problem.

When it is desired to position the two rotatable bodies of the ball throwing machine vertically so as to impart a spin to the ball around its horizontal axis, this would result in the holder member coming in contact with the connecting portion between the base and the ball body. Thus, it is difficult to turn the ball throwing machine body so as to bring the two rotatable bodies in a vertical position. As a result, pitches are limited in type, so that for example, a pitch which rises just short of the batter, i.e., a hop cannot be obtained.

SUMMARY OF THE INVENTION

An object of this invention is to make it possible to obtain various types of pitches by making it possible to arbitrarily select the direction of spin of the ball when the ball is thrown.

Another object of the invention is to make it possible to obtain more types of pitches by making it possible to vertically change the ball throwing position.

A further object of the invention is to increase the durability of an apparatus for producing various types of pitches.

Still another object of the invention is to simplify the arrangement of an apparatus for producing various types of pitches and to facilitate the operation thereof.

BRIEF DESCRIPTION OF THE DRAWINGS

The drawings illustrate a preferred embodiment of the present invention.

DESCRIPTION OF THE PREFERRED EMBODIMENTS

Figure 1:
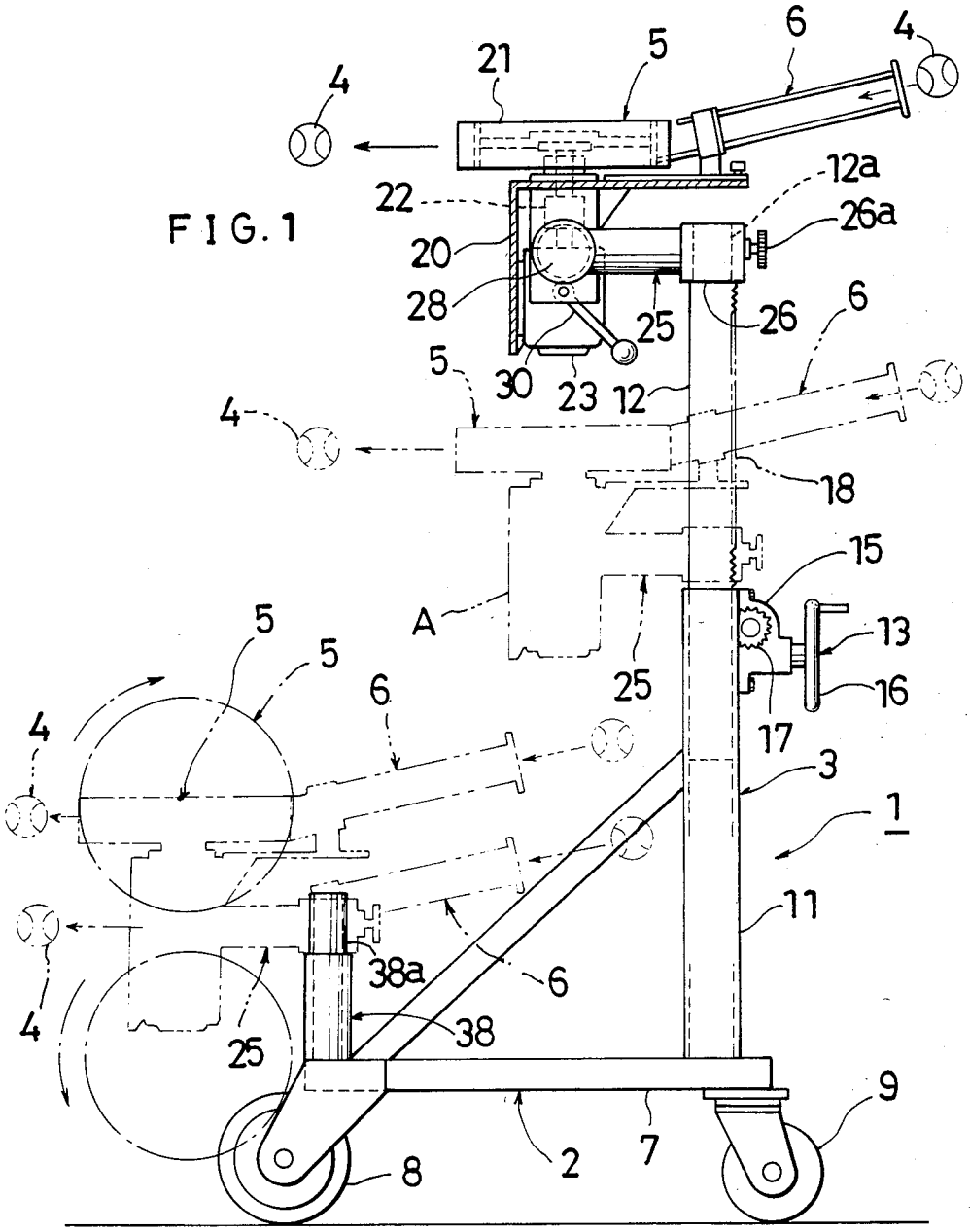
FIG. 1 is a front view of a ball throwing machine.
Figure 2:
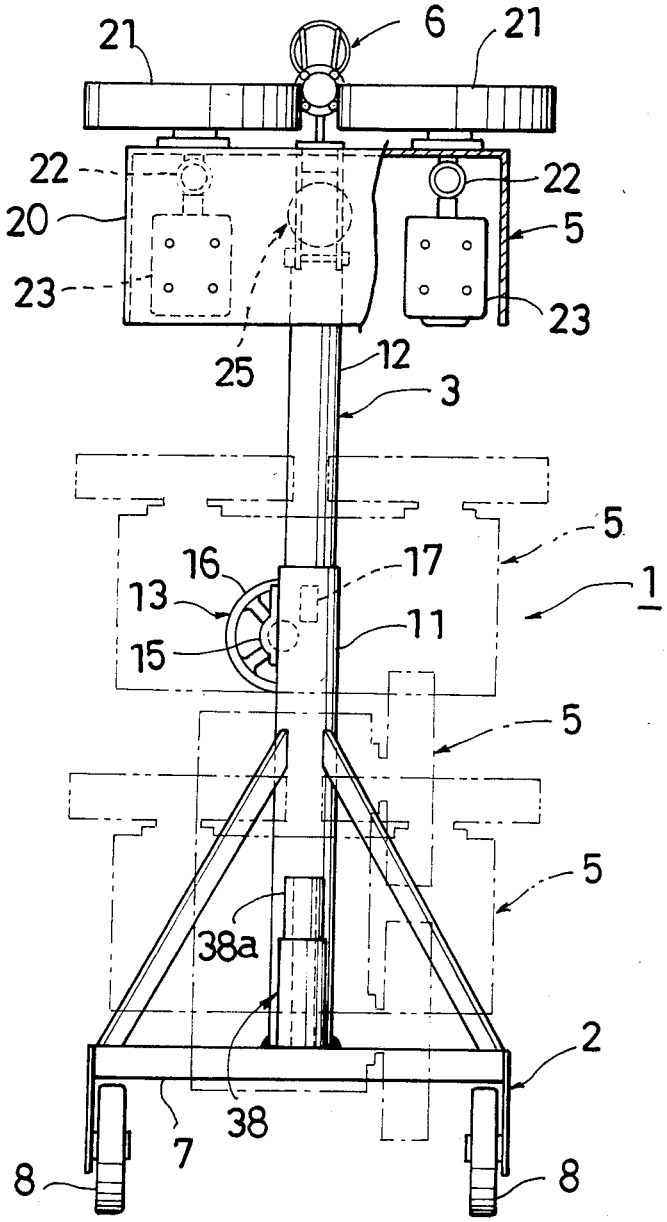
FIG. 2 is a side view of the ball throwing machine.
Figure 3:
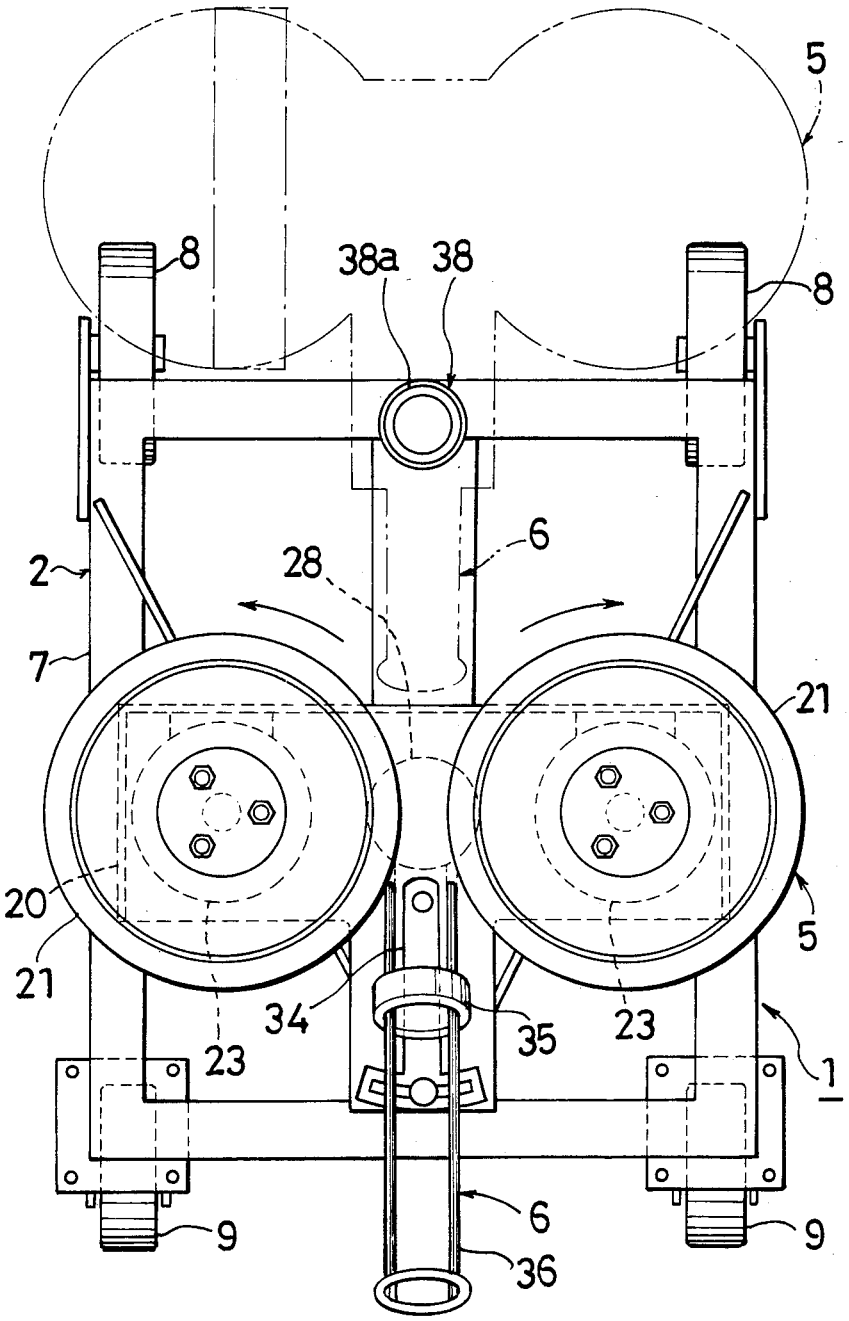
FIG. 3 is a plan view of the ball throwing machine.
Figure 4:
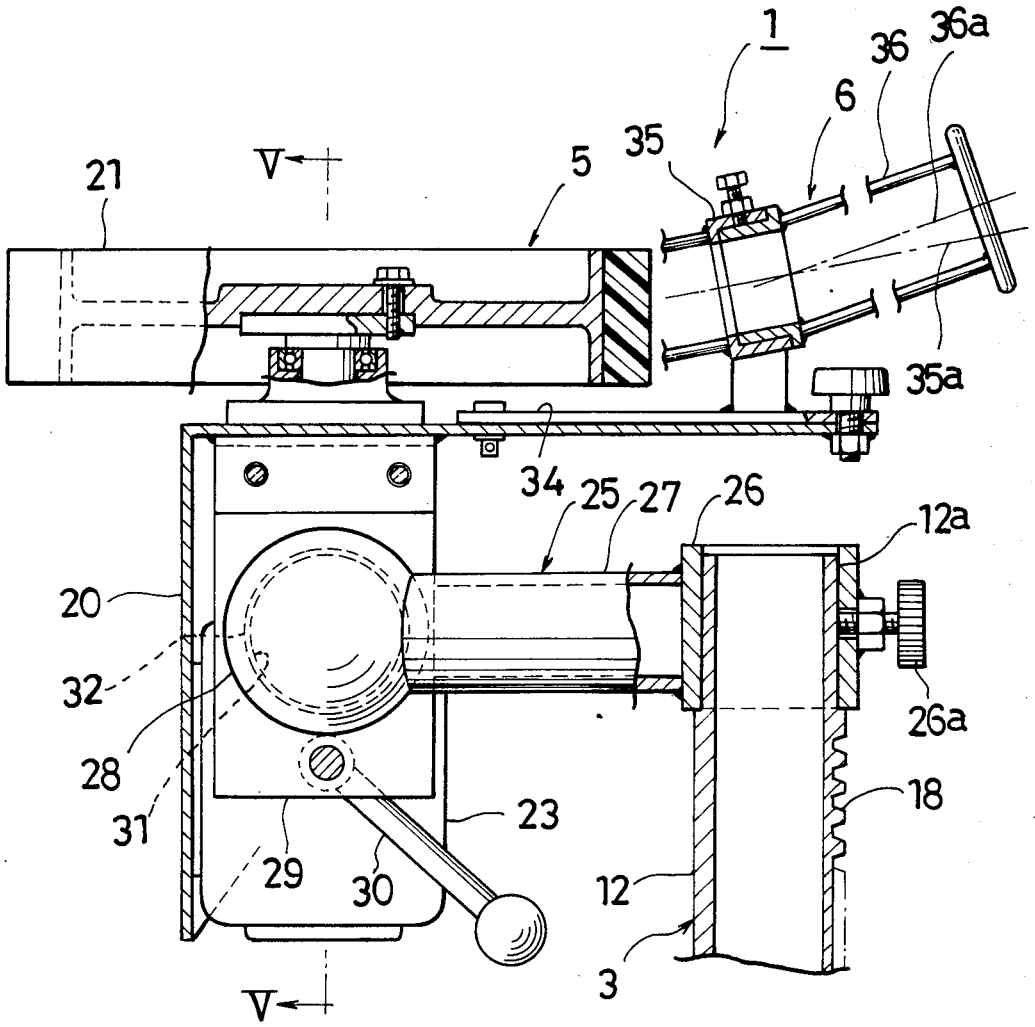
FIG. 4 is an enlarged sectional view of a portion of FIG. 1.
Figure 5:
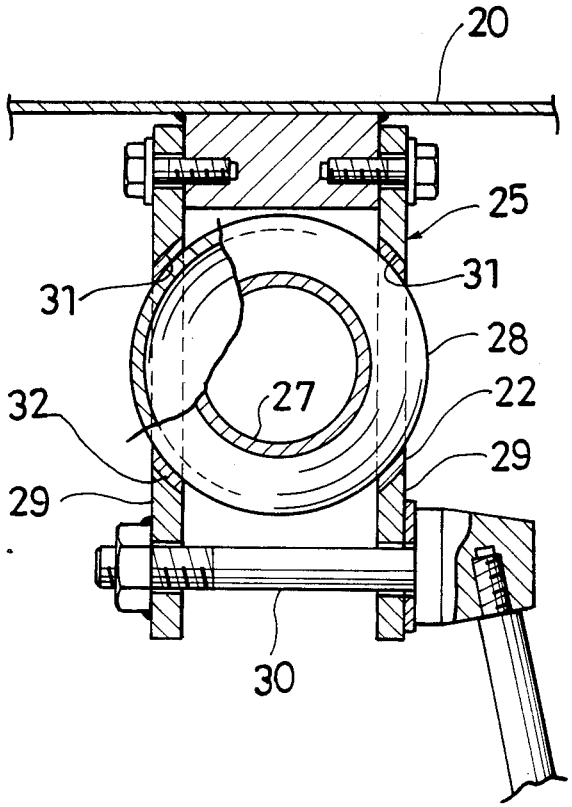
FIG. 5 is a section taken along the line V—V of FIG. 4.

A ball throwing machine 1 comprises a carriage 2, a pillar member 3 installed on said carriage 2, a ball throwing machine body 4 supported on the upper end of said pillar member 3 for throwing balls 4, and a ball feeder 6.

Referring to said carriage 2, it has a base 7 framed in ractangular form when seen in a plan view. For movement of the ball throwing machine 1, the base 7 is provided in its front portion with a pair of front wheels 8 and in its rear portion with a pair of rear wheels 9. The rear wheels 9 are casters.

The pillar member 3 forms an extensible, double tube type elevator. That is, a fixed tube 11 of circular cross-section is erected on the rear upper surface of the base 7 and a movable tube 12 of circular cross-section is axially slidably fitted in said fixed tube 11. And, drive means 13 for lifting and lowering the movable tube 12 is provided to enable said movable tube 12 to serve as a lifting-lowering movable part.

The drive means 13 has a worm gearing 15. The worm in this worm gearing 15 is connected to a handle 16, while the worm wheel has a rack pinion 17 connected thereto. On the other hand, the movable tube 12 is formed with a rack gear 18. The rack gear 18 meshes with said rack pinion 17, so that the movable tube 12 can be lifted and lowered by rotating the handle 16.

The ball throwing machine body 5 has a pair of disk-like rotatable bodies 21 supported on a support platform 20, and dc motors 23 respectively connected to said rotatable bodies 21 through flexible couplings 22. The rotatable bodies are rotated in opposite directions by an unillustrated electric equipment and the balls 4 are nipped between the rotatable bodies 21 and thereby thrown. Further, the rotative speeds of the rotatable bodies 21 can be made different from each other by an unillustrated frequency converter and the resulting spin of the balls 4 changes the balls 4, when thrown, to shoots or curves.

The ball throwing machine body 5 is supported on the upper end of the movable tube 12 of the pillar member 3 through ball joint type support means 25.

Referring to the support means 25, the upper end of the movable tube 12 is formed with a shaft member **12*a* of smaller diameter, and a sleeve 26 is turnably fitted on said shaft member 12*a*. And, a support tube 27 projects from the sleeve 26 forwardly of the ball throwing direction and substantially horizontally, with a ball body 28 supported on the projecting end of said support tube 27. The sleeve 26 can be fixed to the shaft member 12*a* by screwing a stop bolt 26*a*. In the above case, the support tube 27 may project from the sleeve 26** rearwardly of the ball throwing direction and substantially horizontally.

On the other hand, a holder member is installed on said support platform 20. This holder member has a pair of opposed holder plates 29. These holder plates 29 are fixed at their upper ends to the support platform 20 by bolts. Their lower ends are free and there is provided a clamp 30 for clamping said lower ends. The holder plates 29 are formed with circular openings 31 which are axially aligned with each other. And, both sides of said ball body 28 are fitted in said openings 31. In this case, an annular resin material 32, such as urethane is interposed between the ball body 28 and each opening 31, said resin material 32 being glued to the inner surface of the opening 31.

When the clamp 30 is loosened, the ball body 28 and the holder plates 29 are allowed to turn relative to each other, whereby the ball throwing direction of the ball throwing machine body 5 can be changed to coincide with any desired direction around the ball body. Further, when the clamp 30 is tightened, the ball throwing machine body 5 is fixed to the movable tube 12. In the above case, the resin materials 32 protect the outer surface of the ball body 28 from being damaged by the inner surfaces of the openings 31. As a result, the durability of the support means 25 is improved.

Referring to the aforesaid ball feeder 6, an angle change plate 34 is pivotally supported on said support platform 20, and an inclined, support sleeve 35 is fixed on said angle change plate 4. And, a guide member 36 for guiding the balls 4 to the nip between the rotatable bodies 21 is fitted in said support sleeve 35 so that it is turnable around the axis of the support sleeve. The axis 36*a* of this guide member 36 is inclined with respect to the axis 35*a* of the support sleeve 35, so that by turning the guide member 36 around the axis 35*a* of the support sleeve 35, the angle of inclination of the guide member 36 with respect to the horizontal plane can be arbitrarily set within certain limits.

Erected on the front upper surface of the base 7 is a cylindrical support member 38 capable of supporting the ball throwing machine body 5. The support member 38 is positioned below the level of the shaft member 12*a* of the movable tube 12 when the latter is moved to its lowermost position, the upper end of said support member 38 being formed with a shaft member 38*a* of the same shape as said shaft member 12*a*. By selectively attaching the support means 25 to the shaft member 12*a* of the movable tube 12 and to the shaft member 38*a* of the support member 38, the ball throwing machine body 5 can be selectively attached to the shaft member 12*a* of the movable tube 12 and to the shaft member 38 of the support member 38. In the above case, since the ball throwing machine body 5 can be attached either to the movable tube 12 or to the support member 38 by simply fitting the support means 25 on the shaft member 12*a* or 38*a*, the arrangement is simple and the operation is easy.

According to the ball throwing machine 1 arranged in the manner described above, the ball throwing machine body 5 can be positioned at a desired height and in a desired posture and hence various types of pitches can be obtained.

The operation of the ball throwing machine 1 will now be described. If the movable tube 12 is lifted to place the ball throwing machine body 5 at the upper position, overhand pitching becomes possible (as shown in solid lines in the figures). Further, if the movable tube 12 is lowered to place the ball throwing machine body 5 at the lower position, sidearm pitching becomes possible (as shown in dash-double-dot lines in the figures). Further, if the ball throwing machine body 5 is attached to the support member 38, underhand pitching becomes possible (as shown in dash-double-dot lines in the figures).

If the two rotatable bodies 21 are rotated at substantially the same speed at the respective aforesaid positions, a straight ball and a ball which drops suddenly just short of the batting position (so-called fork ball) can be thrown. In this case, if the rotatable bodies 21 are horizontally disposed and rotated at different speeds, a shoot and a curve can be produced, with the ball 4 rotated around its vertical axis.

Further, at the respective aforesaid positions, if the support means 25 is manipulated to turn the ball throwing machine body 5 around the axis extending in the ball throwing direction so as to bring the rotatable bodies 21 to their inclined position and if the rotatable bodies 21 are rotated at different speeds, then with the assumption of a right-handed or left-handed pitcher it is possible to throw a ball which spins around an inclined axis (so-called slider). Further, if the rotatable bodies 21 are vertically disposed as in the above (as shown in dash-dot lines in the figures), it is possible to produce a pitch which drops just short of the batting position (so-called drop) or a pitch which reversely rises (so-called hop) by spinning the ball 4 around its horizontal axis.

On the other hand, at the respective aforesaid positions it is possible to change the ball throwing direction vertically or horizontally by manipulating the support means 25.

While the above is based on the illustrated example, the ball body 28 may be provided on the ball throwing machine body 5 and the holder plates 29 on the base 7.

What is claimed is:

1. A ball throwing machine including a ball throwing machine body having a pair of rotatable bodies adapted to be rotated in opposite directions and at different speeds with a ball nipped therebetween to be thereby thrown, a pillar member extending upwardly from a base, and support means for supporting the ball throwing machine body on the top of the pillar member, said ball throwing machine being characterized in that said support means is of the ball joint type comprising a ball body and a support member holding said ball body and adapted to be turnable around the center of said ball body, said ball body projecting in a substantially horizontal direction forwardly or rearwardly from one of the elements, the ball throwing machine body and the pillar member, said holder member projecting on the other element, said ball body and said holder member being adapted to be fixed in a relative, arbitrary turned posture.

2. A ball throwing machine as set forth in claim 1, wherein the holder member comprises a pair of holder plates, and a clamp for clamping the free ends of said holder plates, each of said holder plates being formed with a circular opening, the ball body being fitted at its opposite sides in these openings through a resin material applied to the inner surface of each opening, the arrangement being such that loosening the clamp enables the ball body and holder plates to be turned relative to each other while tightening the clamp enables the ball body and holder plates to be fixed together.

3. A ball throwing machine as set forth in claim 2, wherein the pillar member is in the form of an extensible, double tube type elevator and said ball throwing machine body is supported on the lifting-lowering movable part of said elevator through the support means.

4. A ball throwing machine as set forth in claim 3, further including a support member capable of supporting the ball throwing machine body on the base at a position below the level of the lowermost position of the lifting-lowering movable part through the support means, so that said ball throwing machine body can be selectively attached to said lifting-lowering movable part and said support member through the support means.

5. A ball throwing machine as set forth in claim 4, wherein the lifting-lowering movable part and the support member have upwardly projecting shaft members of the same shape, so that the support means can be supported by both of these shaft members by fitting engagement therebetween.

* * * * *